US005593819A

United States Patent [19]

Kimura et al.

[11] Patent Number: 5,593,819

[45] **Date of Patent: *Jan. 14, 1997**

[54] BASE FILM FOR PHOTOGRAPHIC FILM

[75] Inventors: Manabu Kimura; Hideshi Kurihara; Tetsuo Ichihashi, all of Matsuyama; Satoshi Kitazawa, Sagamihara, all of Japan

[73] Assignee: Teijin Limited, Osaka, Japan

[ * ] Notice: The term of this patent shall not extend beyond the expiration date of Pat. No. 5,290,835.

[21] Appl. No.: 538,580

[22] Filed: Oct. 3, 1995

Related U.S. Application Data

[63] Continuation of Ser. No. 223,681, Apr. 6, 1994, Pat. No. 5,457,017.

[30] Foreign Application Priority Data

| | | | |
|---|---|---|---|
| Apr. 9, 1993 | [JP] | Japan | 5-083213 |
| Sep. 20, 1993 | [JP] | Japan | 5-233288 |
| Jan. 12, 1994 | [JP] | Japan | 6-001643 |

[51] Int. Cl.[6] ..... G03C 1/76

[52] U.S. Cl. ..... 430/533; 430/523; 430/537; 430/531; 428/480; 428/213; 428/220; 528/272; 528/298

[58] Field of Search ..... 430/533, 523, 430/537, 531; 428/480, 213, 220; 528/272, 298

[56] References Cited

U.S. PATENT DOCUMENTS

| | | | |
|---|---|---|---|
| 3,875,119 | 4/1975 | Aoki et al. | 528/298 |
| 5,096,803 | 3/1992 | Kanetake et al. | 430/533 |
| 5,288,601 | 2/1994 | Greener et al. | 430/533 |
| 5,326,689 | 7/1994 | Murayama | 430/533 |
| 5,334,457 | 8/1994 | Wada et al. | 430/533 |
| 5,380,577 | 1/1995 | Hamano et al. | 428/143 |
| 5,457,017 | 10/1995 | Kimura et al. | 430/533 |

FOREIGN PATENT DOCUMENTS

| | | |
|---|---|---|
| 0581120 | 2/1994 | European Pat. Off. . |
| 2266191 | 10/1975 | France . |
| 1454956 | 11/1976 | United Kingdom . |
| 9213021 | 8/1992 | WIPO . |

*Primary Examiner*—Mark F. Huff
*Attorney, Agent, or Firm*—Sherman and Shalloway

[57] ABSTRACT

A base Film for a photographic film, wherein (A) the base film is formed of a polyethylene-2,6-naphthalenedicarboxylate copolymer formed from 2,6-naphthalenedicarboxylic acid as a main acid component and ethylene glycol as a main glycol component; (B) a solution of 10 mg/ml of said copolymer in a hexafluoroisopropanol/chloroform mixed solvent having a hexafluoroisopropanol/chloroform weight ratio of 2/3 shows a light transmittance, $T_{400}$, of at least 97%/cm at a wavelength of 400 nm; (C) the film has a yellow index, $Y_{ID}$, of 5 or less; and (D) the film has a haze value of 2.0% or less.

19 Claims, No Drawings

BASE FILM FOR PHOTOGRAPHIC FILM

This is a continuation of application Ser. No. 08/223,681, filed Apr. 6, 1994, and issued on Oct. 10, 1995 as U.S. Pat. No. 5,457,017.

DETAILED DESCRIPTION OF THE INVENTION

The present invention, relates to a base film for a photographic film. More specifically, it relates to a base film for a photographic film, which is excellent in transparency and hue and free from, or almost free from, whitening in a fold and which is formed of a polyethylene-2,6-naphthalenedicarboxylate copolymer as a raw material.

A biaxially oriented polyethylene-2,6-naphthalenedicarboxylate film has excellent mechanical, thermal and electrical properties, and has been and is studied for use in a variety of fields. Further, it is practically used in the fields of a magnetic recording medium and electric insulation.

For example, a film is used in the field of a photosensitive material, and this field is largely classified into a field where it is used in the form of a sheet such as an X-ray film, a printing film or a cut film and a field where it is used as a roll film. The typical example of the roll film is a color or black and white negative film which is 35 mm wide or less and used in a film cartridge to be encased in a general camera for taking photos.

A biaxially oriented polyester film formed of a polyethylene terephthalate is mainly used as a base film for a film in the form of a sheet, and a film of a cellulose polymer typified by triacetyl cellulose (to be sometimes abbreviated as "TAC" hereinafter) is mainly used as a base for a roll film.

A TAC film has characteristic features in that it is free of optical anisotropy, that it has high transparency and that it is excellent in the property of freedom from curling after being treated for development. It is generally said that the excellent freedom of a TAC film from curling is the feature which does not belong to a film of any other material. Since, however, an organic solvent is used in the step of producing a TAC film, it is required to recover the solvent completely for the prevention of environmental pollution. In particular, environmental destruction is one of the issues which attract attention, and there is an intense tendency to avoid the use of an organic solvent which may cause environmental destruction.

On the other hand, a polyethylene terephthalate film is that which can be formed by a melt extrusion method using no organic solvent, and it is used as a base film for a photosensitive material in part of the field of photosensitive materials.

However, a polyethylene terephthalate film involves problems in that it undergoes curling (curling tendency) and that it is difficult to remove the curling.

Japanese Laid-open Patent Publication No. 1-244446 (244,446/1989) discloses a photosensitive material formed of a polyester base film having a haze of 3% or less and a water content of at least 0.5% by weight and at least one photosensitive layer. The feature of this photosensitive material is that the base film has a water content of at least 0.5% by weight, and for accomplishing this water content, an aromatic dicarboxylic acid component having metal sulfonate is copolymerized.

The above photosensitive material is improved in the reduction of the curling tendency. However, it is insufficient in other properties, since it has defects in that the dimensional stability decreases due to the moisture absorption and that the deformation of film side portions increases due to a decrease in glass transition temperature.

In recent years, the use of a photosensitive material has been diversified, and the rate of feeding a film at the time of taking photographs is increased, and the size of a camera is decreased. Thus, a photosensitive material is required to have performances such as strength, dimensional stability and suitability to forming a thin film as well as the freedom from curling tendency. These requirements can be satisfied by none of a triacetate film and a modified polyethylene terephthalate film, and it is desired to develop a film for a photosensitive material.

Meanwhile, it is known that polyethylene-2,6-naphthalenedicarboxylate is a raw material excellent in strength, dimensional stability and the suitability to forming a thin film. However, a film of polyethylene-2,6-naphthalenedicarboxylate is not necessarily sufficient in transparency and hue as a base film for a photographic film. Moreover, it has a defect in that a fold is whitened.

Japanese Laid-open Patent Publication No. 50-28595 (28,595/1975) discloses a process for the production of a polyester, which comprises esterifying and ester-interchanging an acid component containing naphthalenedicarboxylic acid and/or an ester-forming derivative thereof and a diol component containing 1,4-cyclohexanedimethanol and/or an ester-forming derivative thereof and polycondensing the resultant bisdiol ester of naphthalendicarboxylic acid and/or a low polymer thereof.

The above Publication also discloses that the performances of the so-obtained polyester are that it has a high secondary transition point, that it is excellent in dimensional stability, transparency and heat resistance and that it can be hence used as a raw material for a film.

Japanese Laid-open Patent Publication No. 1-201324 (201,324/1989) discloses a highly transparent copolyester for an optical device, which is formed from naphthalenedicarboxylic acid as an acid component and a mixture of 50 to 82 mol. % of 1,4-cyclohexanedimethanol and 50 to 18 mol. % of ethylene glycol as a glycol component and has a refractive index, n, of at least 1.6 and an Abbe's number, $\upsilon$, of at least 30.

The polyesters disclosed in the above two Laid-open Publications have a feature in that their glycol component is 1,4-cyclohexanedimethanol.

It is an object of the present invention to provide a base film for a-photographic film.

It is another object of the present invention to provide a base film for a photographic film, which has excellent transparency and hue, particularly has a low tinge of yellow.

It is further another object of the present invention to provide a base film for a photographic film, whose fold is not whitened or hardly whitened.

Other objects and advantages of the present invention will be apparent from the following description.

According to the present invention, the above objects and advantages of the present invention are achieved by a base film for a photographic film, wherein:

(A) the base film is formed of a polyethylene-2,6-naphthalenedicarboxylate copolymer formed from 2,6-naphthalenedicarboxylic acid as a main acid component and ethylene glycol as a main glycol component, (B) a solution of 10 mg/ml of said copolymer in a hexafluoroisopropanol/chloroform mixed solvent having a hexafluoroisopropanol/chloroform weight ratio of 2/3 shows a light transmittance, $T_{400}$, of at least 97%/cm at a wavelength of 400 nm, (C) the film has a yellow index, $Y_{ID}$, of 5 or less, and (D) the film has a haze value of 2.0% or less;

The raw material for the base film for a photographic film, provided by the present invention, is a polyethylene-2,6-naphthalenedicarboxylate copolymer which is formed from 2,6-naphthalenedicarboxylic acid as a main acid component and ethylene glycol as a main glycol component. Examples of a secondary acid component include aromatic dicarboxylic acids such as 2,7-naphthalenedicarboxylic acid, 1,5-naphthalenedicarboxylic acid, terephthalic acid, isophthalic acid, diphenylethanedicarboxylic acid, diphenyldicarboxylic acid, diphenyl ether dicarboxylic acid, diphenylsulfonedicarboxylic acid, diphenyl ketone dicarboxylic acid and anthracenedicarboxylic acid; aliphatic dicarboxylic acids such as sebacic acid and adipic acid; and alicyclic dicarboxylic acids such as cyclohexane-1,4-dicarboxylic acid.

For the polyethylene-2,6-naphthalenedicarboxylate copolymer, the amount of 2,6-naphthalenedicarboxylic acid as a main acid component is preferably 90 to 99.5 mol. %, more preferably 90 to 98 mol. %. That is, the amount of a secondary acid component is preferably 0.5 to 10 mol. %, more preferably 2 to 10 mol. %. The secondary acid component is preferably terephthalic acid.

For the above polyethylene-2,6-naphthalenedicarboxylate used in the present invention, ethylene glycol is used as a main glycol component. Examples of a secondary glycol component include alicyclic diols such as 1,4-cyclohexanedimethanol; polymethylene glycols having 3 to 10 carbon atoms such as trimethylene glycol, tetramethylene glycol, pentamethylene glycol, hexamethylene glycol and decamethylene glycol; aromatic diols such as hydroquinone, resorcin and 2,2-bis(4-hydroxyphenyl)propane; and polyoxyalkylene glycols having a molecular weight of 600 to 5,000, such as polyethylene glycol, polypropylene glycol and polytetramethylene glycol.

For the above copolymer used in the present invention, the amount of ethylene glycol as a main glycol component is 60 to 99.5 mol. %, more preferably 80 to 98 mol. %, particularly preferably 90 to 97 mol. %. That is, the amount of a secondary glycol component is 0.5 to 40 mol. %, more preferably 2 to 20 mol. %, particularly preferably 3 to 10 mol. %. The secondary glycol component is preferably 1,4-cyclohexanedimethanol. The 1,4-cyclohexanedimethanol may be one having a trans-form, one having a cis-form or a mixture of these.

Furthermore, as shown by the following examples and comparative examples in the polyethylene-2,6-naphthalenedicarboxylate copolymer according to this invention it is possible for either the acid component, 2,6-naphthalenedicarboxylate, to be present in an amount of 100 mol. % based on the total acid component, or the glycol component, ethylene glycol, to be present in an amount of 100 mol. % based on the total glycol component. However, the copolymer does not, simultaneously, include 100 mol. % of 2,6-naphthalenedicarboxcylic acid as the acid component and 100 mol. % of ethylene glycol as the glycol component. More specifically, when 100 mol. % of the acid units are 2,6-naphthalenedicarboxcylic acid, then from 60 to 99.5 mol. % of the glycol units comprise ethylene glycol. Conversely, when 100 mol. % of the glycol units comprise ethylene glycol, than 90 to 99.5 mol. % of the acid units comprise 2,6-naphthalenedicarboxylic acid.

For the polyethylene-2,6-naphthalenedicarboxylate copolymer, a component derived from an oxycarboxylic acid may be copolymerized or bonded in an amount of 20 mol. % or less based on the total amount of the acid components so long as the effects of the present invention are not impaired. The oxycarboxylic acid includes an aromatic oxy acid such as hydroxybenzoic acid and aliphatic oxy acid such as ω-hydroxycaproic acid.

Further, for the polyethylene-2,6-naphthalenedicarboxylate copolymer used in the present invention, a trifunctional or higher polycarboxylic acid or polyhydroxy compound such as trimellitic acid or pentaerythritol may be copolymerized so long as the polyethylene-2,6-naphthalenedicarboxylate copolymer is linear and so long as the effects of the present invention are not impaired, for example, in an amount of 2 mol. % or less based on the total amount of the acid components.

The polyethylene-2,6-naphthalenedicarboxylate copolymer used in the present invention particularly advantageously contains an ethylene-2,6-naphthalenedicarboxylate unit in an amount of more than 60 mol. % and less than 97 mol. % based on the total recurring unit amount.

The above copolymer used in the present invention may contain inert fine particles as a lubricant.

The inert fine particles can be incorporated, for example, by a method in which inert fine particles such as $SiO_2$, $BaSO_4$, $CaCO_3$, aluminosilicate or crosslinked organic particles are externally added, or by a method in which inert fine particle are internally formed by precipitating a catalyst during the production of the polyethylene-2,6-naphthalenedicarboxylate copolymer. In order to ensure the transparency of the film, the particles which are to be externally added preferably have a refractive index close to that of the polyethylene-2,6-naphthalenedicarboxylate. For example, $BaSO_4$, aluminosilicate and crosslinked organic particles (crosslinked polystyrene) are preferred.

For advantageously maintaining the transparency of the film, preferred is a method in which a thin film containing inert fine particles is laminated on at least one surface of a film of the polyethylene-2,6-naphthalenedicarboxylate copolymer which substantially does not contain particles. For this purpose, it is effective to employ a co-extrusion method using a plurality of extruder and a feed block or a multimanifold die.

The polyethylene-2,6-naphthalenedicarboxylate copolymer used in the present invention can be produced by a conventional polyester production method. For example, an acid and a glycol are directly subjected to an esterification reaction, or when dialkyl ester is used as an acid component, the alkyl ester and glycol are subjected to an ester-interchange reaction and then heat-polymerized under reduced pressure to remove an excess of the glycol component, whereby the copolymer can be obtained.

The above copolymer used in the present invention preferably has a glass transition temperature of at least 90° C., more preferably at least 100° C.. When this glass transition temperature is too low, a film in the form of a roll is liable to be deformed in edge portions, and the edge portions are liable to crinkle to render the film flatness defective. Such a film is undesirable as a base film. It is therefore preferred to determine the kinds and amounts of the comonomers while taking the glass transition temperature into account.

Further, the above copolymer shows a melt-viscosity of preferably 5,000 to 20,000 poise, more preferably 5,000 to 12,000 poise when measured at 295° C. at a shear rate of 300 $sec^{-1}$. The copolymer which shows the above melt-viscosity has excellent film formability, and it can be formed into a film having excellent transparency without causing heat deterioration and with preventing a change in hue, particularly an increase in the tinge of yellow.

The transparency of the base film for a photographic film, provided by the present invention, is defined by both the light transmittance of a solution prepared by dissolving the film in a solvent and the haze value of the film per se. That is, a solution prepared by dissolving 10 mg/ml of the above copolymer in a hexafluoroisopropanol/chloroform mixed solvent having a hexafluoroisopropanol/chloroform weight ratio of 2/3 shows a light transmittance, $T_{400}$, of at least 97 %/cm at a wavelength of 400 nm. The above light transmittance, $T_{400}$ is preferably at least 98 %/cm.

The value of $T_{400}$, is greatly influenced by the comonomers for the polyethylene-2,6-naphthalenedicarboxylate copolymer, precipitated particles in the film, added lubricant particles, a catalyst residue, a crystallized product and foreign substances and further by heat deterioration during the film formation. When $T_{400}$ is less-than 97%/cm, undesirably, the photosensitivity of the film to light having a short wavelength is defective when the film is used as a base film for a photographic film, and the color tone is biased when the film is used as a base film for a color photographic film.

In the base film of the present invention, the difference between its light transmittance $T_{400}$ at a wavelength of 400 nm and its light transmittance $T_{420}$ at a wavelength of 420 nm ($\Delta T=T_{420}-T_{400}$) is preferably 2 %/cm or less.

The transparency of the base film of the present invention is further defined by a haze value which is 2.0% or less. The haze value of the base film is preferably 1.5% or less.

The base film of the present invention has another feature in that it has a very low tinge of yellow. The tinge of yellow can be shown on the basis of a yellow index $Y_{ID}$. The base film of the present invention has a $Y_{ID}$ value of 5 or less, preferably 4 or less.

Further, the base film of the present invention has an excellent advantage that the degree of whitening of a fold of the film is much smaller than that of whitening of a fold of a film formed from a polyethylene-2,6-naphthalenedicarboxylate homopolymer as a raw material. The degree of whitening of a fold can be shown on the basis of an index called a fold whitening ratio. The fold whitening ratio of the base film of the present invention is preferably 15% or less, more preferably 10% or less.

Due to the advantage of the base film of the present invention that it has a small fold whitening ratio, for example, the whitening of portions around holes formed by perforation and the growth of damage caused by a contact to a metal can be avoided.

The base film of the present invention can be produced, for example, by the following method.

The polyethylene-2,6-naphthalenedicarboxylate copolymer is extruded in the form of a film at a temperature between its melting point (Tm: °C.) and (Tm+60)°C., rapidly cooling the extrudate to form an unstretched film having an intrinsic viscosity of at least 0.5 dl/g (preferably 0.5 to 0.9 dl/g), then stretching the unstretched film in a monoaxial direction (in the longitudinal or transverse direction) at a stretch ratio of 2 to 5 at a temperature between (Tg−10) and (Tg+50)+C. (in which Tg refers to the glass transition temperature of the polyethylene-2,6-naphthalenedicarboxylate copolymer), stretching the monoaxially stretched film in the direction at right angles with the first stretching direction at a stretch ratio of 2 to 5 at a temperature between Tg (°C.) and (Tg+50° C.) and subjecting the biaxially stretched film to a heat set treatment. The heat set treatment is preferably carried out at a temperature between (Tg+60)°C. and (Tg+120)°C.

The base film of the present invention preferably has a thickness in the range of from 40 to 120 μm, more preferably in the range of from 60 to 100 μm.

The base film of the present invention has excellent transparency and hue. and therefore can be advantageously used as a base film for a photographic film.

The present invention will be explained more in detail with reference to Examples, but it should be noted that the invention is not limited by these Examples without departing from the scope of the invention. In Examples, "part" stands for "part by weight". Values of various properties described in Examples were measured as follows.

(1) Transmittances of light having a wavelength of 400 nm and light having a wavelength of nm ($T_{400}$, $T_{420}$)

0.25 Gram of a film was dissolved in a hexafluoroisopropanol/chloroform mixed solvent (weight·ratio=2/3) to prepare a 25 ml solution (10 mg/ml), and the solution was measured with a self-recording spectrophotometer UV-3101 PC (supplied by Shimadzu Corporation) for a transmittance of light having a wavelength of 400 nm and a transmittance of light having a wavelength of 420 nm ($T_{400}$ and $T_{420}$, unit=%/cm).

(2) Yellow index $Y_{ID}$ of film $Y_{ID}$ of a film was determined using a differential calorimeter SZ-290 supplied by Nippon Denshoku Kogyo K. K. and on the basis of the following equation.

$$Y_{ID}=\frac{100}{Y}\times(1.28X-1.06Z)$$

wherein X, Y and Z are tristimulus values determined by the International Commission on Illumination and defined in ASTM, vol. 8.02 D1925-70.

(3) Film haze (fogging degree)

A film was measured for a haze with an integrating sphere method HTR meter according to JIS-K6714.

Evaluation:

A=Haze of less than 2%, excellent transparency

B=Haze of 2–5%

C=Haze of more than 5%, poor transparency (4) Fold whitening ratio

A film sample having a size of 80 mm×80 mm was prepared, manually folded into two, placed between flat metal plates add pressed with a press machine under a predetermined pressure $P_1$ (kg/cm$^2$G) for 20 seconds. After being pressed, the two-folded film was manually restored to its original state, placed between the above metal plates and pressed under the pressure $P_1$ (kg/cm$^2$G) for 20 seconds. The film sample was taken out, and measured for a total length (mm) of whitened portions.

Six fresh film samples were treated in the same manner as above except that the pressure $P_1$ was set at 1, 2, 3, 4, 5 and 6 kg/cm$^2$G. , The fold whitening ratio was defined as a ratio of an average of the total length of whitened portions caused after each pressing to the total length of the fold (80 mm), and this value was taken as an index for the likelihood of a fold causing whitening.

Fold whitening ratio=total length of whitened portions (mm)/(80 mm×6)×100

(5) Scratch resistance

A film was set in a Heldon-14 type measuring apparatus (Shinto Scientific Co., Ltd), and the film was allowed to run with a diamond needle in contact with the film surface and evaluated for scratch resistance on the basis of a scratched state.

A: No scratch occurred. Excellent

B: Film surface was scratched to some extent. Film was still usable.

C: Film surface was scratched.

D: Film surface was deeply scratched. Defective.

(6) Glass transition temperature

A polymer was measured with a differential thermal calorimeter (DSC2100-model, supplied by du Pont) for a glass transition peak temperature at a temperature elevation rate of 20° C./minute.

EXAMPLE 1

100 Parts of dimethyl 2,6-naphthalenedicarboxylate, 43 parts of ethylene glycol and 17 parts of cyclohexanedimethanol were ester-interchanged in the presence of 0.04 part of manganese acetate tetrahydrate as a catalyst according to a conventional method, and then 0.06 part of trimethyl phosphate and 0.03 part of antimony trioxide were added. Then, the mixture was subjected to a polycondensation at a high temperature under vacuum according to a conventional method to give a polyethylene -2,6-naphthalenedicarboxylate copolymer having an intrinsic viscosity of 0.60 and a glass transition temperature of 114° C.

The above-obtained polyester was dried at 180° C. and formed into a sheet with an extruder. The sheet was formed into a film under the conditions shown in Table 1-2 to give a film having a thickness of 75 μm.

The so-obtained film was heat treated at 100° C. for 2 days, and then evaluated for various properties to show excellent properties as shown in Table 1-1.

EXAMPLES 2–3 AND COMPARATIVE EXAMPLE 1

Copolymer films were obtained in the same manner as in Example 1 except that the compositions and amounts of raw materials were changed as shown in Table 1-1.

The copolymer films which satisfied the requirements of the present invention showed excellent properties, while the copolymer film other than those had some defects.

TABLE 1-2-continued

| | |
|---|---|
| $X_4$ | 110 |
| Annealing conditions: | |
| Temperature-increased up to 100° C. over 24 hours, maintained at 100° C. for 24 hours, and then temperature-decreased to room temperature over 24 hours. | |

EXAMPLE 4

93 Parts of dimethyl 2,6-naphthalenedicarboxylate, 7 parts of dimethyl terephthalate [QA:TA=95:5 molar ratio (QA stands for 2,6-naphthalenedicarboxylic acid, TA for terephthalic acid)] and 60 parts of ethylene glycol were ester-interchanged in the presence of 0.04 part of manganese acetate tetrahydrate as an ester-interchange catalyst according to a conventional method, and then 0.06 part of trimethyl phosphate was added to terminate the ester-interchange reaction substantially.

Further, 0.023 part of antimony trioxide was added, and the mixture was subjected to a polycondensation reaction at a high temperature under vacuum according to a conventional method to give a. polyethylene-2,6-naphthalenedicarboxylate copolymer having an intrinsic viscosity of 0.6 dl/g [phenol/tetrachloroethane mixed solvent (weight ratio=1:1), 35° C.].

Pellets of the above-obtained polyethylene-2,6-naphthalenedicarboxylate were dried at 180° C. for 3 hours, fed to a bopper of an extruder and melted at 280° to 300° C. The molten polymer was extruded onto a rotary cooling drum having a surface temperature of 20° C. through a 1-mm slit die to obtain an unstretched film. The so-obtained unstretched film was preliminarily heated at 75° C., and formed into a film under the conditions shown in Table 1–2 to give a film having a thickness of 75 μm.

The above-obtained film was heat treated at 100° C. for 2 days, and then evaluated for various properties to show excellent properties as shown in Table 2.

TABLE 1-1

| | Acid component | | Glycol component | | Glass transition temp. | Scratch | $T_{400}$ | | Film haze | Fold whitening ratio |
|---|---|---|---|---|---|---|---|---|---|---|
| | Component | mol % | Component | mol % | (°C.) | resistance | (%) | $Y_{ID}$ | (%) | (%) |
| Ex. 1 | 2,6-naphthalene-dicarboxylic acid | 100 | ethylene glycol<br>hexamethylene-dimethanol | 85<br>15 | 114 | B | 97.4 | 3.3 | 0.4 | 10 |
| Ex. 2 | 2,6-naphthalene-dicarboxylic acid<br>Isophthalic acid | 90<br>10 | ethylene glycol<br>hexamethylene-dimethanol | 97<br>3 | 112 | B | 98.2 | 3.2 | 0.4 | 0 |
| Ex. 3 | 2,6-naphthalene-dicarboxylic acid | 100 | ethylene glycol<br>hexamethylene-dimethanol<br>diethylene glycol | 80<br>15<br>5 | 103 | A | 97.1 | 3.7 | 0.5 | 9 |
| CEx. 1 | 2,6-naphthalene-dicarboxylic acid | 100 | ethylene glycol | 100 | 117 | D | 95.8 | 3.8 | 0.4 | 60 |

Ex. = Example, CEx. = Comparative Example

TABLE 1-2

| | |
|---|---|
| Stretching in longitudinal direction: | |
| stretch ratio | 3.0 |
| temperature (°C.) | 135 |
| Stretching in transverse direction: | |
| stretch ratio | 3.3 |
| temperature (°C.) | 145 |
| Heat set zone temperature (°C.) | |
| $X_1$ | 220 |
| $X_2$ | 215 |
| $X_3$ | 189 |

EXAMPLE 5

A polymer and a film were obtained in the same manner as in Example 4 except that the molar ratio of an acid component was changed to QA:TA–90:10. The values of the properties were all excellent as shown in Table 2.

EXAMPLE 6

A polymer and a film were obtained in the same manner as in Example 4 except that dimethyl terephthalate as a comonomer acid component was replaced with dimethyl isophthalate. The values of the properties were generally excellent as shown in Table 2. However, the glass transition temperature was low as compared with the case where terephthalate was used as a comonomer acid component, and the property of restoration from curling was also somewhat poor.

properties required of a base film for a photographic film. Table 3 shows the properties of the film.

EXAMPLE 9

100 Parts of 2,6-naphthalenedicarboxylic acid, 4.2 parts of terephthalic acid, 53 parts of ethylene glycol and 6.5 parts of cyclohexanedimethanol were directly ester-interchanged under pressure, and then 0.024 part of antimony trioxide was added. Then, the mixture was subjected to a polycondensation reaction at a high temperature under vacuum to give a polyethylenenaphthalate copolymer having an intrinsic viscosity of 0.60 dl/g [phenol/tetrachloroethane mixed solvent (weight ratio=1:1), 35° C.].

Then, the above copolymer was treated in the same manner as in Example 7 to give excellent results almost similar to those in Example 7. Table 3 shows the properties of the film.

TABLE 2

| | Main acid component | | Comonomer acid component | | | Melt viscosity | Glass transition temp. | | Haze | $T_{400}$ | $T_{420}$ | | Film | Fold whitening ratio |
|---|---|---|---|---|---|---|---|---|---|---|---|---|---|---|
| | kind | mol % | kind | mol % | [η] | (poise) | (°C.) | Hue | transparency | (%) | (%) | $Y_{ID}$ | haze | (%) |
| Ex. 4 | QA | 93 | TA | 7 | 0.60 | 8,200 | 115 | A | A | 97.3 | 82 | 3.4 | 0.4 | 5 |
| Ex. 5 | QA | 90 | TA | 10 | 0.60 | 5,800 | 111 | A | A | 97.6 | 88 | 3.2 | 0.3 | 3 |
| Ex. 6 | QA | 95 | IA | 5 | 0.60 | 7,700 | 103 | A | A | 97.2 | 82 | 3.6 | 0.5 | 7 |

QA: 2,6-naphthalenedicarboxylic acid
TA: terephthalic acid
IA: isophthalic acid
Ex. = Example

EXAMPLE 7

100 Parts of dimethyl 2,6-naphthalenedicarboxylate, 4.2 parts of dimethyl terephthalate, 53 parts of ethylene glycol and 6.5 parts of cyclohexanedimethanol (molar ratio= 95:5:95:5) were ester-interchanged in the presence of 0.032 part of manganese acetate tetrahydrate as an ester-interchange catalyst according to a conventional method, and then 0.023 part of trimethyl phosphate was added to terminate the ester-interchange reaction substantially. Further, 0.024 part of antimony trioxide was added, and the mixture was subjected to a polycondensation reaction at a high temperature under vacuum according to a conventional method to give a polyethylene-2,6-naphthalenedicarboxylate copolymer having an intrinsic viscosity of 0.6 dl/g [phenol/tetrachloroethane mixed solvent (weight ratio=1:1) , 35° C.].

Pellets of the above-obtained copolymer were dried at 180° C. for 3 hours, and were formed into a film in the same manner as in Example 1 to give a film having a thickness of 75 μm.

The above-obtained film was heat treated at 100° C. for 2 days, and then evaluated for various properties to show excellent properties as shown in Table 3.

EXAMPLE 8

A film was obtained in the same manner as in Example 7 except that the acid component/glycol component molar ratio was changed as shown in Table 3. This film satisfied the

COMPARATIVE EXAMPLES 2 AND 3

Example 7 was repeated except that the acid component and glycol component were changed as shown in Table 3. Table 3 shows the properties of the films obtained. Both the films obtained in Comparative Examples 2 and 3 had a nonuniform thickness.

The above results clearly show the following; A film which satisfies the requirements of the present invention exhibits excellent properties as a base film for a photographic film, while other film has some defects and cannot be used as base film for a photographic film.

TABLE 3

| | Acid component (mol %) | | | Glycol component (mol %) | | | | $T_g$ | $T_{420}$ | | Film | Fold whitening ratio | Scratch |
|---|---|---|---|---|---|---|---|---|---|---|---|---|---|
| | QA | TA | other | EG | CHDM | other | [η] | (°C.) | (%) | $Y_{ID}$ | haze | (%) | resistance |
| Ex. 7 | 95 | 5 | — | 95 | 5 | — | 0.60 | 120 | 99.3 | 3.1 | 0.4 | 0 | A |
| Ex. 8 | 90 | 10 | — | 80 | 20 | — | 0.60 | 120 | 99.5 | 2.9 | 0.3 | 0 | A |
| Ex. 9 | 95 | 5 | — | 95 | 5 | — | 0.60 | 120 | 99.4 | 3.0 | 0.4 | 0 | A |

TABLE 3-continued

| | Acid component (mol %) | | | Glycol component (mol %) | | | | $T_g$ | $T_{420}$ | | Film | Fold whitening ratio | Scratch |
|---|---|---|---|---|---|---|---|---|---|---|---|---|---|
| | QA | TA | other | EG | CHDM | other | [η] | (°C.) | (%) | $Y_{ID}$ | haze | (%) | resistance |
| CEx. 2 | 95 | 5 | — | 30 | 70 | — | 0.42 | 105 | 98.2 | — | — | 72 | C |
| CEx. 3 | 70 | 30 | — | 30 | 70 | — | 0.45 | 98 | 99.3 | — | — | 60 | D |

QA: 2,6-naphthalenedicarboxylic acid
TA: terephthalic acid
EG: Ethylene glycol
CHDM: Cyclohexanedimethanol
Ex. = Example
CEx. = Comparative Exampje

What is claimed is:

1. A film suitable as a base film for photographic film, consisting essentially of (A) polyethylene-2,6-naphthalenedicarboxylate copolymer, the acid component units of which comprise 90 to 100 mol. % 2,6-naphthalenedicarboxylic acid and the glycol component units of which comprise 60 to 100 mol. % ethylene glycol, with the proviso that when 100 mol. % of the acid units are 2,6-naphthalenedicarboxylic acid then from 60 to 99.5 mol. % of the glycol units comprise ethylene glycol and when 100 mol. % of the glycol units comprise ethylene glycol then 90 to 99.5 mol. % of the acid units comprise 2,6-naphthalenedicarboxylic acid, wherein (B) light transmittance, $T_{400}$, of the film, measured through a solution of 10 mg/ml of said film in a hexafluoroisopropanol/chloroform mixed solvent having a hexafluoroisopropanol/chloroform weight ratio of 2/3 is at least 97%/cm at a wavelength of 400 nm, (C) the film has a yellow index, $Y_m$, of 5 or less, and (D) the film has a haze value of 2.0% or less.

2. The base film of claim 1, wherein a secondary acid component to the acid component for the polyethylene-2,6-naphthalenedicarboxylate copolymer is terephthalic acid.

3. The base film of claim 6, wherein the acid component contains 0.5 to 10 mol. % of the terephthalic acid.

4. The base film of claim 1, wherein a secondary glycol component to the glycol component for the polyethylene-2,6-naphthalenedicarboxylate copolymer is 1,4-cyclohexanedimethanol.

5. The base film of claims 4, wherein the glycol component contains 0.5 to 40 mol. % of the 1,4-cyclohexanedimethanol.

6. The base film of claim 5, wherein the glycol component contains 1 to 20 mol. % of the 1,4-cyclohexanedimethanol.

7. The base film of claim 1, wherein the light transmittance, $T_{400}$, at a wavelength of 400 nm is at least 98%/cm.

8. The base film of claim 1, wherein the film has a yellow index, $Y_{ID}$, of 4 or less.

9. The base film of claim 1, wherein the film has a haze value of 1.5% or less.

10. The base film of claim 1, wherein a difference between the light transmittance, $T_{400}$ at a wavelength of 400 nm and a light transmittance, $T_{420}$, at a wavelength of 420 nm ($\Delta T=T_{420}-T_{400}$) is 2%/cm or less.

11. The base film of claim 1, wherein the film has a fold whitening ratio of 15% or less.

12. The base film of claim 1, wherein the film has a thickness in the range of from 40 to 120 μm.

13. The base film of claim 1 further characterized by having a fold whitening ratio of less than 10%.

14. The base film of claim 1 further characterized by having a fold whitening ratio of 0%.

15. A photographic film comprising the base film of claim 1 and a layer of photosensitive material supported on said base film.

16. A base film suitable for use as a base film for photographic film, consisting essentially of (A) polyethylene-2,6-naphthalenedicarboxylate copolymer comprising as acid component from 90 to 100 mol. % 2,6-naphthalenedicarboxylic acid and from 0 to 10 mol. % terephthalic acid and as glycol component from 60 to 100 mol. % ethylene glycol and 0 to 40 mol. % 1,4-cyclohexanedimethanol, with the proviso that when 100 mol. % of the acid units are 2,6-naphthalenedicarboxylate acid then at least 0.5 mol. % of the glycol units are 1,4-cyclohexanedimethanol, and when 100 mol. % of the glycol units are ethylene glycol then at least 0.5 mol. % of the acid units are terephthalic acid, said copolymer having a melt viscosity of from 5,000 to 20,000 poise measured at 295° C. at a shear rate of 300 $sec^{-1}$ and a glass transition temperature of at least 90° C.; and, wherein the film is further characterized by (B) light transmittance, $T_{400}$, of the film, measured at a wavelength of 400 nm through a solution of said film in a mixed solvent of hexafluoroisopropanol and chloroform at a weight ratio of 2/3 and containing 10 mg of said film per ml of said mixed solvent is at least 98%/cm;

(C) yellow index, $Y_{ID}$, of 4 or less;

(D) haze value of 1.5% or less; and (E) fold whitening ratio of 0%.

17. A photographic film comprising the base film of claim 16 and a layer of photosensitive material supported on said base film.

18. A film suitable as a base film for photographic film, consisting essentially of (A) polyethylene-2,6-naphthalenedicarboxylate copolymer, the acid component units of which comprise 90 to 100 mol. % 2,6-naphthalenedicarboxcylic acid and the glycol component units of which comprise 60 to 99.5 mol. % ethylene glycol, wherein (B) light transmittance, $T_{400}$, of the film, measured through a solution of 10 mg/ml of said film in a hexafluoroisopropanol/chloroform mixed solvent having a hexafluoroisopropanol/chloroform weight ratio of 2/3 is at least 97%/cm at a wavelength of 400 nm, (C) the film has a yellow index, $Y_{ID}$, of 5 or less, and (D) the film has a haze value of 2.0% or less.

19. A film suitable as a base film for photographic film, consisting essentially of (A) polyethylene-2,6-naphthalenedicarboxylate copolymer, the acid component units of which comprise 90 to 99.5 mol. % 2,6-naphthalenedicarboxylic acid and the glycol component units of which comprise 60 to 100 mol. % ethylene glycol, wherein (B) light transmittance, $T_{400}$, of the film, measured through a solution of 10 mg/ml of said film in a hexafluoroisopropanol/chloroform mixed solvent having a hexafluoroisopropanol/chloroform weight ratio of 2/3 is at least 97%/cm at a wavelength of 400 nm, (C) the film has a yellow index, $Y_m$, of 5 or less, and (D) the film has a haze value of 2.0% or less.

* * * * *

UNITED STATES PATENT AND TRADEMARK OFFICE

CERTIFICATE OF CORRECTION

PATENT NO. : 5,593,819

DATED : January 14, 1997

INVENTOR(S) : KIMURA, ET AL.

It is certified that error appears in the above-indentified patent and that said Letters Patent is hereby corrected as shown below:

On the cover page of the Patent in the section titled "Notice":

Please delete: Pat. No. 5,290,835

Please insert: Pat. No. 5,457,017

Signed and Sealed this

Twenty-fourth Day of June, 1997

Bruce Lehman

*Attest:*

BRUCE LEHMAN

*Attesting Officer*

*Commissioner of Patents and Trademarks*